US010990035B2

(12) United States Patent
Tajima

(10) Patent No.: US 10,990,035 B2
(45) Date of Patent: Apr. 27, 2021

(54) TONER CONTAINER AND IMAGE FORMING APPARATUS

(71) Applicant: KYOCERA Document Solutions Inc., Osaka (JP)

(72) Inventor: Shinichi Tajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/931,014

(22) Filed: Jul. 16, 2020

(65) Prior Publication Data

US 2021/0018858 A1 Jan. 21, 2021

(30) Foreign Application Priority Data

Jul. 17, 2019 (JP) ..... JP2019-131885

(51) Int. Cl.
*G03G 15/08* (2006.01)
*G03G 15/00* (2006.01)

(52) U.S. Cl.
CPC ..... *G03G 15/0862* (2013.01); *G03G 15/0867* (2013.01); *G03G 15/5016* (2013.01); *G03G 2215/0675* (2013.01)

(58) Field of Classification Search
CPC ..... G03G 15/0862; G03G 15/0867; G03G 15/0877
USPC ..... 399/27, 258, 262
See application file for complete search history.

(56) References Cited

U.S. PATENT DOCUMENTS 8,923,734 B2 * 12/2014 Abler et al. ..... G03G 15/0877 399/262
9,146,502 B1 * 9/2015 Eto ..... G03G 15/0877
9,229,366 B2 * 1/2016 Shibata ..... G03G 15/0877
9,354,547 B2 * 5/2016 Konishi et al. .... G03G 15/0877
10,234,789 B2 * 3/2019 Kawanoet etal. .. G03G 15/0877

FOREIGN PATENT DOCUMENTS

JP 2006194980 A 7/2006

* cited by examiner

*Primary Examiner* — William J Royer
(74) *Attorney, Agent, or Firm* — Studebaker & Brackett PC

(57) ABSTRACT

A toner container includes a container main body, a conveying body, at least one first rotating body, and a second rotating body. The container main body has a compartment and an exit port. The compartment contains toner. The exit port allows the toner to be ejected from the compartment. The conveying body is located inside the compartment. The conveying body moves in a direction approaching the exit port while rotating to convey the toner to the exit port. The first rotating body engages with an outer circumferential surface of the conveying body and rotates according to rotation of the conveying body. The second rotating body rotates according to a first driving force generated by rotation of the first rotating body. The first rotating body is located at a prescribed position. The first rotating body rotates in response to the conveying body arriving at the prescribed position.

8 Claims, 8 Drawing Sheets

TONER CONTAINER AND IMAGE FORMING APPARATUS

INCORPORATION BY REFERENCE

The present application claims priority under 35 U.S.C. § 119 to Japanese Patent Application No. 2019-131885, filed on Jul. 17, 2019. The contents of this application are incorporated herein by reference in their entirety.

BACKGROUND

The present disclosure relates to a toner container and an image forming apparatus.

A known process cartridge is attachable to and detachable from a main body of an image forming apparatus. The process cartridge is an integration of a photosensitive drum, a charger, a cleaner, a development device, and a drive transmission device. The development device includes a toner container, a developing section, and a stirring section. The toner container contains toner. The stirring section stirs the toner inside the toner container. In detail, the stirring section includes a stirring drive shaft and a toner stirring member attached to the stirring drive shaft. The toner stirring member rotates and the toner is stirred through rotation of the stirring drive shaft. The main body of the image forming apparatus includes a drive motor and a control means. The drive transmission device transmits driving force of the drive motor of the main body of the image forming apparatus to the stirring drive shaft of the developing section. The drive transmission device includes a rotation count detecting means. The rotation count detecting means detects a rotation count of the stirring drive shaft. The rotation count detecting means includes a detecting plate and a detecting member. The detecting plate is fixed to the stirring drive shaft. The detecting plate is disk-shaped and has a slit therein. The detecting member detects rotation of the detecting plate. The rotation count detecting means outputs a signal indicating the detected rotation count of the stirring drive shaft to the control means. The control means detects an amount of remaining toner based on the rotation count of the stirring drive shaft detected by the detecting member.

SUMMARY

A toner container according to an aspect of the present disclosure includes a container main body, a conveying body, at least one first rotating body, and a second rotating body. The container main body has a compartment and an exit port. The compartment contains toner. The exit port allows the toner to be ejected from the compartment. The conveying body is located inside the compartment. The conveying body moves in a direction approaching the exit port while rotating to convey the toner to the exit port. The first rotating body engages with an outer circumferential surface of the conveying body and rotates according to rotation of the conveying body. The second rotating body rotates according to a first driving force generated by rotation of the first rotating body. The first rotating body is located at a prescribed position. The first rotating body rotates in response to the conveying body arriving at the prescribed position.

An image forming apparatus according to another aspect of the present disclosure forms an image on a sheet. The image forming apparatus includes the above toner container, a driving section, a detector, and a processor. The second rotating body has detection targets on an outer circumferential surface thereof which indicate that the second rotating body has rotated. The driving section generates second driving force which drives the conveying body. The detector detects any of the detection targets from the second rotating body when the second rotating body rotates. The processor calculates a remaining amount of the toner based on a result of detection by the detector.

DETAILED DESCRIPTION

Figure 1:
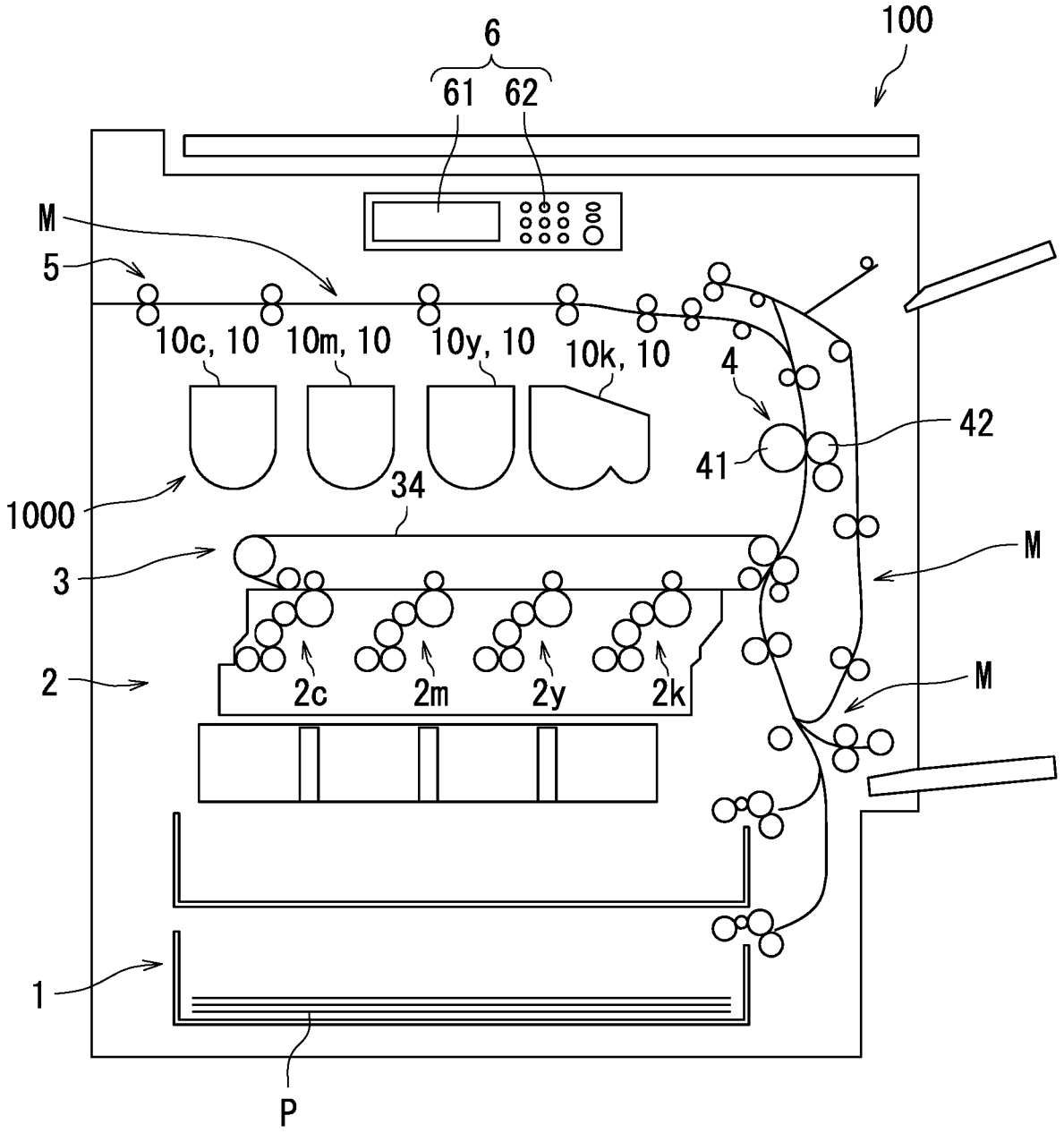
FIG. 1 is a diagram illustrating a configuration of an image forming apparatus according to a first embodiment of the present disclosure.

The following describes a toner container and an image forming apparatus according to embodiments of the present disclosure with reference to the accompanying drawings. Elements that are the same or equivalent are labeled with the same reference signs in the drawings and description thereof is not repeated.

First Embodiment

The following describes an image forming apparatus 100 according to a first embodiment with reference to FIG. 1. FIG. 1 is a diagram illustrating a configuration of the image forming apparatus 100 according to the first embodiment. In the first embodiment, the image forming apparatus 100 is an electrographic color copier.

As illustrated in FIG. 1, the image forming apparatus 100 forms an image on a sheet P. The image forming apparatus 100 includes a feeding section 1, a conveyance section M, a toner replenishing unit 1000, an image forming section 2, a transferring section 3, a fixing section 4, an ejection section 5, and an operation panel 6.

The feeding section 1 feeds the sheet P to the conveyance section M. The feeding section 1 is capable of housing multiple sheets P, and feeds the sheets P to the conveyance section M a sheet at a time starting with the uppermost sheet P.

The conveyance section M conveys a sheet P fed by the feeding section 1 to the ejection section 5 via the transferring section 3 and the fixing section 4.

The toner replenishing unit 1000 supplies toner T to the image forming section 2. In the first embodiment, the toner replenishing unit 1000 includes four toner containers 10*c*, 10*m*, 10*y*, and 10*k*. The toner container 10*c* contains a cyan toner T. The toner container 10*m* contains a magenta toner T. The toner container 10*y* contains a yellow toner T. The toner container 10*k* contains a black toner T. In the following, the toner containers 10*c*, 10*m*, 10*y*, and 10*k* may be generically referred to as a "toner container 10". The toner container 10 is attachable to and detachable from the image forming apparatus 100.

The transferring section 3 includes an intermediate transfer belt 34. The transferring section 3 transfers a toner image formed on the intermediate transfer belt 34 by the image forming section 2 onto the sheet P.

The image forming section 2 forms a toner image on the intermediate transfer belt 34. In detail, the image forming section 2 includes four image forming sections 2*c*, 2*m*, 2*y*, and 2*k*. The cyan toner T is supplied to the image forming section 2*c* from the toner container 10*c*. The magenta toner T is supplied to the image forming section 2*m* from the toner container 10*m*. The yellow toner T is supplied to the image forming section 2*y* from the toner container 10*y*. The black toner T is supplied to the image forming section 2*k* from the toner container 10*k*. Each of the four image forming sections 2*c*, 2*m*, 2*y*, and 2*k* includes a remaining toner amount sensor. The remaining toner amount sensors detect remaining amounts of toner T in the four image forming sections 2*c*, 2*m*, 2*y*, and 2*k*.

The fixing section 4 includes a roller pair which fixes the toner image transferred onto the sheet P by the transferring section 3. The roller pair includes a heating roller 41 and a pressure roller 42. The heating roller 41 and the pressure roller 42 apply heat and pressure to the sheet P. As a result, the fixing section 4 fixes the unfixed toner image to the sheet P. The ejection section 5 ejects the sheet P with a toner image fixed thereto out of the image forming apparatus 100.

The operation panel 6 receives an instruction from a user. The operation panel 6 includes a display section 61 and operation buttons 62. The display section 61 displays the results of various processing. Examples of the display section 61 include a liquid-crystal display panel and an organic electroluminescent (EL) display panel. The operation buttons 62 include a start button, arrow keys, and a numeric keypad.

Figure 2:
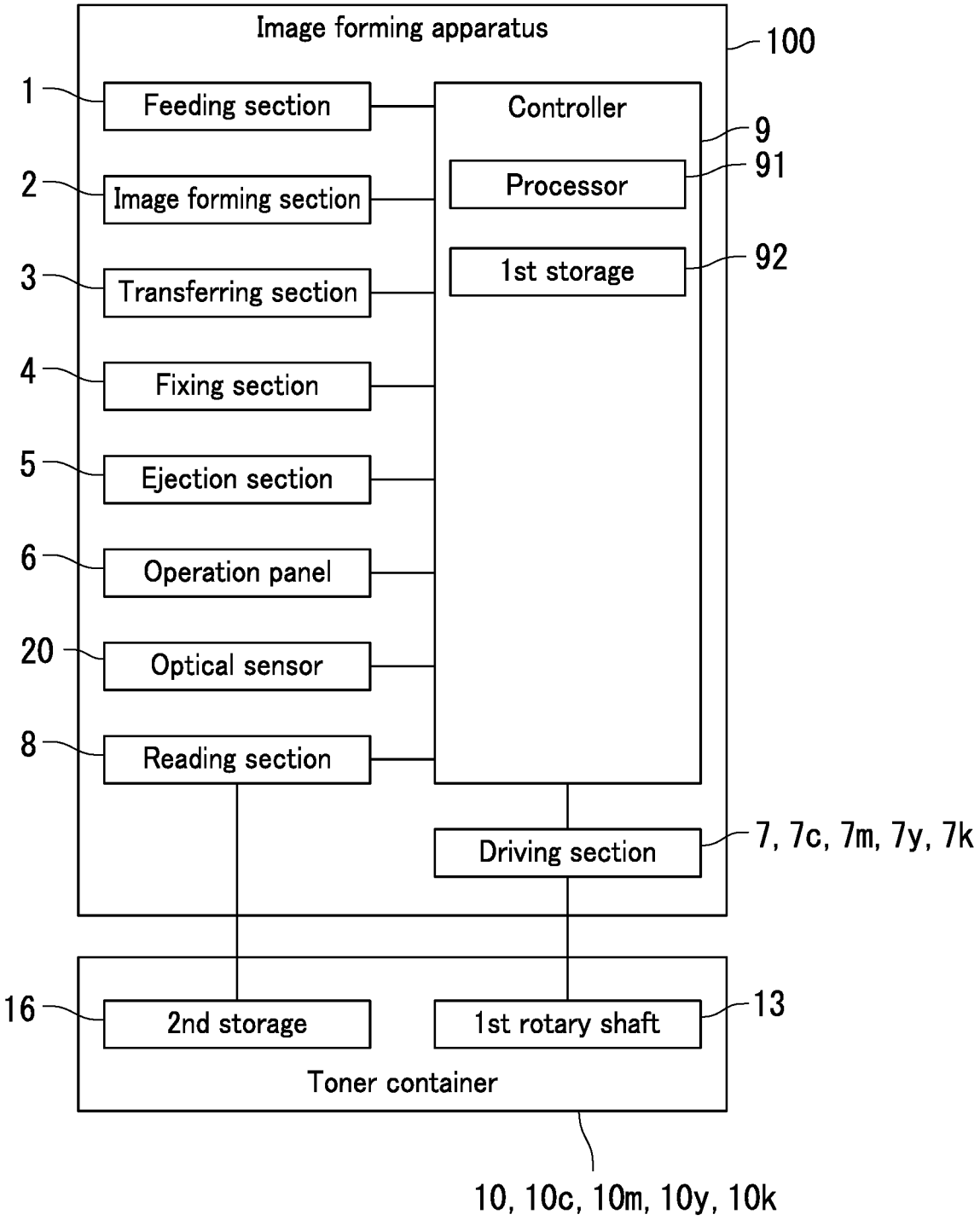
FIG. 2 is a block diagram illustrating the configuration of the image forming apparatus.

The configuration of the image forming apparatus 100 is further described with reference to FIG. 2. FIG. 2 is a block diagram illustrating the configuration of the image forming apparatus 100.

As illustrated in FIG. 2, the image forming apparatus 100 further includes a reading section 8, a controller 9, an optical sensor 20, and four driving sections 7*c*, 7*m*, 7*y*, and 7*k*. The four driving sections 7*c*, 7*m*, 7*y*, and 7*k* are provided respectively for the toner containers 10*c*, 10*m*, 10*y*, and 10*k*. In the following, the driving sections 7*c*, 7*m*, 7*y*, and 7*k* may be generically referred to as a "driving section 7". The optical sensor 20 is described later with reference to FIG. 3. The optical sensor 20 is an example of a detector.

The toner container 10 includes a first rotary shaft 13 and second storage 16. The first rotary shaft 13 is described later with reference to FIG. 3. The second storage 16 stores container identification information therein. The container identification information includes information indicating how many labels L are associated with each of first rotating bodies 14*a* to 14*c* described with reference to FIG. 3. The second storage 16 is an integrated circuit (IC) tag, for example. Labels L each are an example of a detection target. The number of labels L associated with any of the first rotating bodies 14*a* to 14*c* is an example of a characteristic value.

The driving section 7 generates driving force for supplying toner to the image forming section 2 from the toner container 10. In detail, the driving section 7 is a driving source for rotation of the first rotary shaft 13 of the toner container 10. The driving section 7 is a motor, for example. The mechanism by which the driving force of the driving section 7 is transmitted to the first rotary shaft 13 of the toner container 10 is described later with reference to FIG. 3.

The reading section 8 reads the container identification information from the second storage 16 of the toner container 10. The reading section 8 reads the container identification information, for example, when the toner container 10 is attached to the image forming apparatus 100. The reading section 8 includes an antenna, for example. The antenna sends and receives radio waves to communicate with the second storage 16 of the toner container 10.

The controller 9 includes a processor 91 and first storage 92.

The processor 91 is a hardware circuit including a processor such as a central processing unit (CPU). The processor 91 controls the feeding section 1, the image forming section 2, the transferring section 3, the fixing section 4, the ejection section 5, the operation panel 6, the driving section 7, the reading section 8, and the optical sensor 20 by executing a control program stored in the first storage 92.

The processor 91 causes the driving sections 7 corresponding to the four image forming sections 2*c*, 2*m*, 2*y*, and 2*k* to generate driving force based on the output result of the remaining toner amount sensors located in the four image forming sections 2*c*, 2*m*, 2*y*, and 2*k*. The processor 91 calculates the remaining amount of the toner T based on a result of detection by the optical sensor 20. The processor 91 stores the container identification information read by the reading section 8 in the first storage 92.

The processor 91 performs display processing. The display processing is processing through which the processor 91 causes the display section 61 to display various messages related to the state of the toner container 10. The display processing is described later with reference to FIG. 8.

The first storage 92 stores the control program therein. The first storage 92 includes a storage device and semiconductor memory. The storage device includes either or both of a hard disk drive (HDD) and a solid-state drive (SSD). The semiconductor memory constitutes random-access memory (RAM) and read-only memory (ROM), for example.

Figure 3:
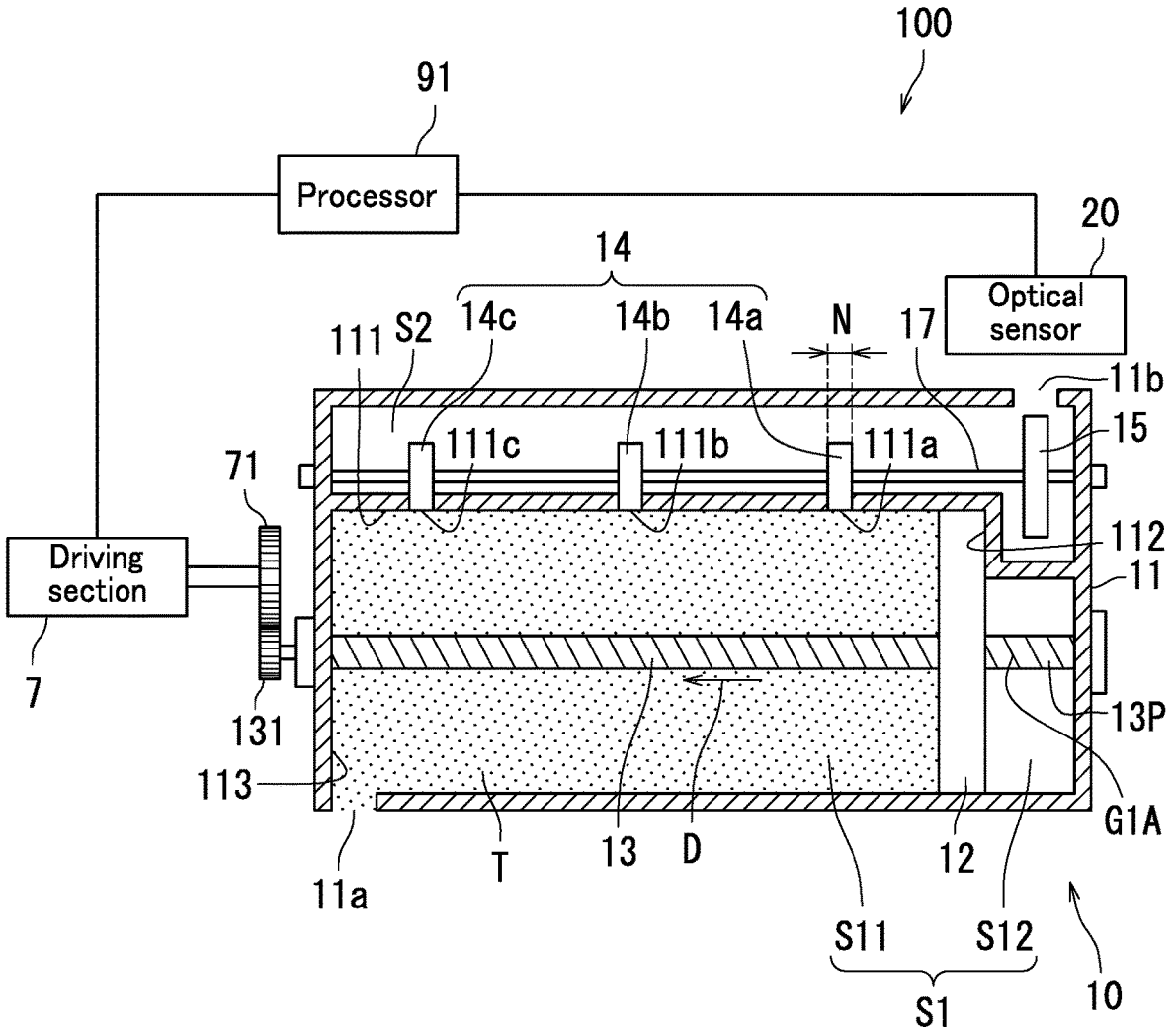
FIG. 3 is a diagram illustrating a cross section of a toner container.

Next, a configuration of the toner container 10 is described with reference to FIGS. 1 to 3. FIG. 3 illustrates a cross section of the toner container 10.

As illustrated in FIG. 3, the toner container 10 includes a container main body 11, a conveying body 12, a first rotary shaft 13, a first rotating body group 14, a second rotary shaft 17, and a second rotating body 15. The first rotating body group 14 includes the first rotating bodies 14*a* to 14*c*.

The container main body 11 includes a first container compartment S1 and a second container compartment S2 on the inside thereof. The first container compartment S1 and the second container compartment S2 are partitioned by a partition wall 111. The first container compartment S1 contains the toner T, the conveying body 12, and the first rotary shaft 13. The first container compartment S1 is a substantially cylindrical space suited to the shape of the conveying body 12. The first container compartment S1 is partitioned into a first space S11 and a second space S12 by the conveying body 12. The toner T is contained in the first space S11. The second container compartment S2 contains the first rotating body group 14, the second rotary shaft 17, and the second rotating body 15.

The first container compartment S1 has an exit port 11*a*. The exit port 11*a* allows the toner T to be ejected out of the container main body 11 from the first container compartment S1. In a state in which the toner container 10 is attached to the image forming apparatus 100, the toner T ejected from the exit port 11*a* is supplied to the image forming section 2.

The second container compartment S2 has an opening 11*b*. The opening 11*b* is formed so that the optical sensor 20 is enabled to detect rotation of the second rotating body 15.

The optical sensor 20 detects presence or absence of a label L fixed to an outer circumferential surface 15P of the second rotating body 15 each time the second rotating body 15 rotates. The label L indicates that the second rotating body 15 has rotated. The optical sensor 20 includes a light receiving and emitting section. The light receiving and emitting section includes a light emitting element and a photo detector. The light emitting element emits light toward the outer circumferential surface 15P of the second rotating body 15. The photo detector receives light reflected by the outer circumferential surface 15P of the second rotating body 15. The light emitting element is a light-emitting diode (LED), for example. The photo detector is a photodiode, for example.

The partition wall 111 has through holes 111*a* to 111*c*. The through holes 111*a* to 111*c* are formed in prescribed positions on the partition wall 111.

The first rotary shaft 13 is rotatably attached to the inside of the container main body 11. The first rotary shaft 13 transmits the driving force of the driving section 7 to the conveying body 12 to cause the conveying body 12 to move while rotating. The first rotary shaft 13 extends in the direction in which the conveying body 12 approaches the exit port 11*a*. In the following, the direction in which the conveying body 12 approaches the exit port 11*a* is referred to as an "exit port direction D". The first rotary shaft 13 has a first spiral groove G1A formed in an outer circumferential surface 13P thereof. One end of the first rotary shall 13 protrudes out of the container main body 11. The image forming apparatus 100 includes a gear 71. The gear 71 rotates due to the driving force of the driving section 7. The toner container 10 includes a gear 131. The gear 131 is fixed to the one end of the first rotary shaft 13. The gear 131 of the toner container 10 is meshed with the gear 71 of the image forming apparatus 100. Therefore, the gear 71 of the image forming apparatus 100 rotates when the driving section 7 generates driving force. When the gear 71 of the image forming apparatus 100 rotates, the gear 131 of the toner container 10 rotates. When the gear 131 of the toner container 10 rotates, the first rotary shaft 13 of the toner container 10 rotates.

Figure 4:
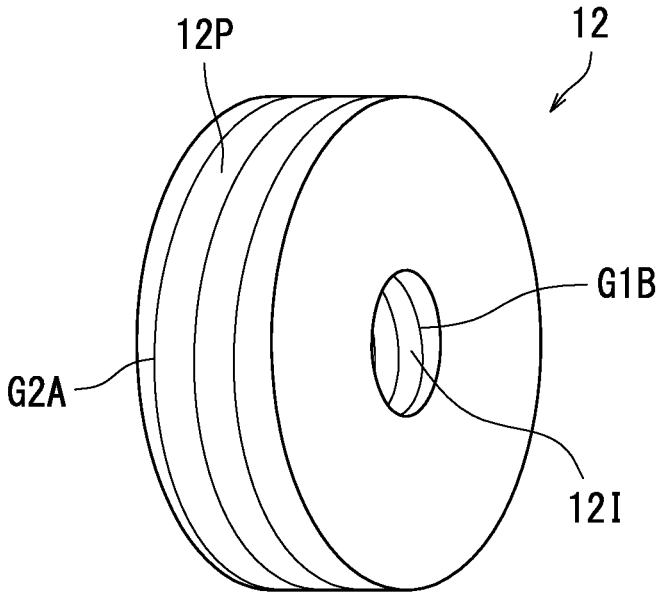
FIG. 4 is a perspective view of a conveying body.

Next, the conveying body 12 is described with reference to FIGS. 1, 3, and 4. FIG. 4 is a perspective view of the conveying body 12. The conveying body 12 moves in the exit port direction D while rotating to convey the toner T to the exit port 11*a*. As illustrated in FIG. 4, the conveying body 12 is torus-shaped. The conveying body 12 is pivotably supported by the first rotary shaft 13. A first spiral groove G1B is formed in an inner circumferential surface 121 of the conveying body 12. The first spiral groove G1B in the conveying body 12 meshes with the first spiral groove G1A in the first rotary shaft 13. In the first embodiment, the conveying body 12 moves in the exit port direction D while rotating when the first rotary shaft 13 rotates. A second spiral groove G2A is formed in an outer circumferential surface 12P of the conveying body 12.

Figure 5:
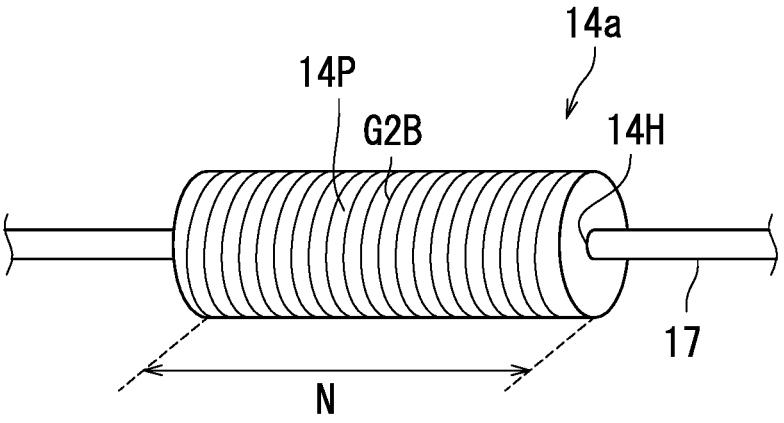
FIG. 5 is a perspective view of a first rotating body and a second rotary shaft.
Figure 6A:
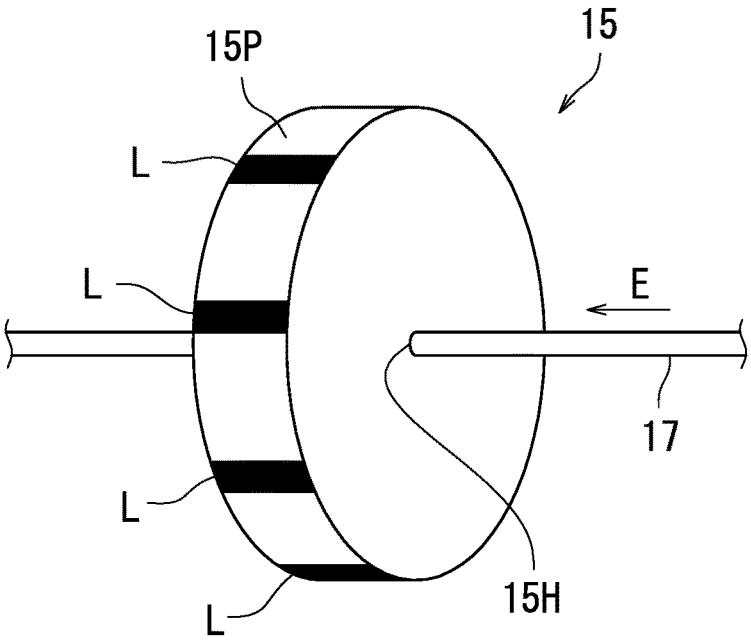
FIG. 6A is a perspective view of a second rotating body and the second rotary shaft.

Next, the first rotating body group 14, the second rotary shaft 17, and the second rotating body 15 are described with reference to FIGS. 1, 3, 5, 6A, and 6B. FIG. 5 is a perspective view of a first rotating body 14*a* and the second rotary shaft 17. FIG. 6A is a perspective view of the second rotating body 15 and the second rotary shaft 17.

The first rotating body group 14 and the second rotating body 15 are fixed to the second rotary shaft 17. That is, the second rotary shaft 17 functions as a rotational axis of the first rotating body group 14 and the second rotating body 15. Accordingly, the second rotating body 15 and the second rotary shaft 17 rotate when the first rotating body group 14 rotates.

The second rotary shaft 17 transmits the driving force generated by the rotation of the first rotating body group 14 to the second rotating body 15. As illustrated in FIG. 3, the second rotary shaft 17 is rotatably attached to the inside of the container main body 11. The second rotary shaft 17 extends in the exit port direction D.

The first rotating body 14*a* engages with the outer circumferential surface 12P of the conveying body 12 and rotates according to the rotation of the conveying body 12. As illustrated in FIG. 5, the first rotating body 14*a* is cylindrical. The first rotating body 14*a* has a through hole 1414 and an outer circumferential surface 14P. The second rotary shaft 17 is inserted into the through hole 14H of the first rotating body 14*a*. A second spiral groove G2B is formed in the outer circumferential surface 14P of the first rotating body 14*a*. The second spiral groove G2B of the first rotating body 14*a* is engageable with the second spiral groove G2A of the conveying body 12. When the second spiral groove G2B engages with the second spiral groove G2A, the first rotating body 14*a* rotates due to the rotation of the conveying body 12. A thickness N of the first rotating body 14*a* is set such that, due to the conveying body 12 moving while rotating, the second rotating body 15 rotates 120° between the start and the end of engagement of the second spiral groove G2A with the second spiral groove G2B.

The configuration of the first rotating body 14*b* and the first rotating body 14*c* is the same as the configuration of the first rotating body 14*a*. Therefore, the second rotating body 15 is rotated once as the conveying body 12 moves from a starting point to an ending point. As illustrated in FIG. 3. the container main body 11 has a first inner wall 112 and a second inner wall 113 in the first container compartment S1. In the first embodiment, the starting point is a position of the conveying body 12 in which the conveying body 12 is in contact with the first inner wall 112. The ending point is a position of the conveying body 12 in which the conveying body 12 is in contact with the second inner wall 113. When the conveying body 12 is at the starting point, the amount of the toner T contained in the first space S11 is at maximum. When the conveying body 12 is at the ending point, the amount of the toner T contained in the first space S11 is practically zero.

As illustrated in FIG. 3, a portion of the first rotating body 14*a* is housed in the through hole 111*a* of the partition wall 111. A portion of the first rotating body 14*b* is housed in the through hole 111*b* of the partition wall 111. A portion of the first rotating body 14*c* is housed in the through hole 111*c* of the partition wall 111. Accordingly, the first rotating body group 14 rotates each time the conveying body 12 arrives at any of the through holes 111*a* to 111*c*.

The second rotating body 15 rotates according to the driving force generated by the rotation of the first rotating body group 14 each time the conveying body 12 engages with any of the first rotating bodies 14*a* to 14*c*. As illustrated in FIG. 6A, the second rotating body 15 is torus-shaped. The second rotating body 15 has a through hole 15H and the outer circumferential surface 15R The second rotary shaft 17 is inserted into the through hole 15H of the second rotating body 15. A plurality of labels L is fixed to the outer circumferential surface 15P of the second rotating body 15.

The labels L differ in reflectivity from the outer circumferential surface 15P of the second rotating body 15. In detail, the reflectivity of the labels L to light emitted by the optical sensor 20 differs from that of the outer circumferential surface 15P of the second rotating body 15. In the first embodiment, the labels L are black but the outer circumferential surface 15P of the second rotating body 15 is not black. The labels L are fixed to the outer circumferential surface 15P of the second rotating body 15 with adhesive. The labels L are black stickers, for example.

Figure 6B:
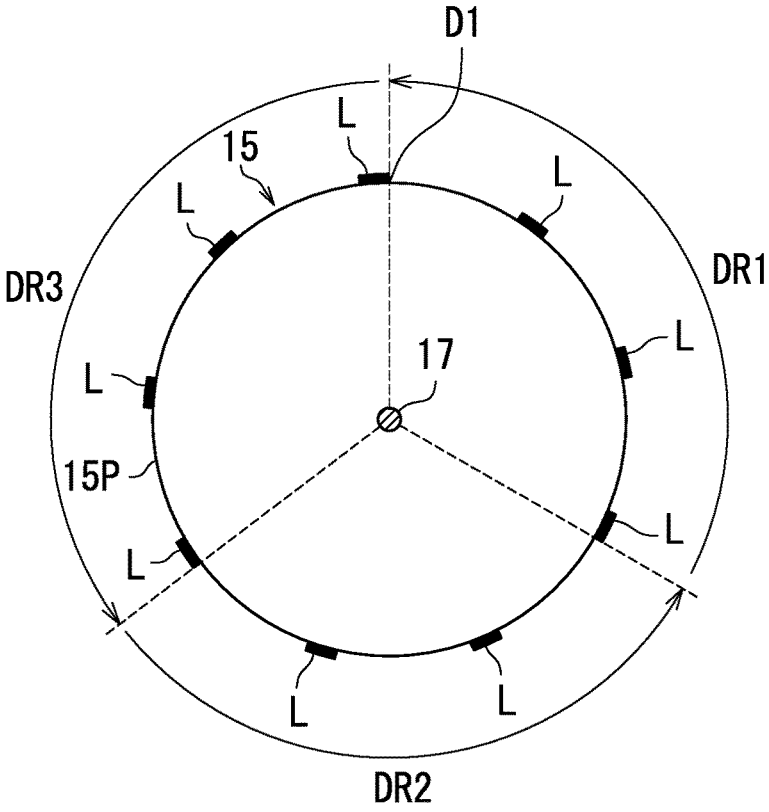
FIG. 6B is a diagram illustrating the second rotating body as viewed from an arrow direction E in FIG 6A.

Next, the number of labels L is described with reference to FIG 6B. FIG 6B is a diagram illustrating the second rotating body 15 as viewed from an arrow direction F in FIG. 6A. In FIG. 6B, a detection position D1 is a position in which the optical sensor 20 detects the presence or absence of a label L. In FIG. 6B, a rotation angle DR1 is an angle by which the second rotating body 15 rotates between the start and the end of engagement of the first rotating body 14*a* with the conveying body 12. In FIG. 6B, a rotation angle DR2 is an angle by which the second rotating body 15 rotates between the start and the end of engagement of the first rotating body 14*b* with the conveying body 12. In FIG. 6B, a rotation angle DR3 is an angle by which the second rotating body 15 rotates between the start and the end of engagement of the first rotating body 14*c* with the conveying body 12. In the first embodiment, the rotation angles DR1 to DR3 are each 120 degrees.

As illustrated in FIG. 6B, three labels L are fixed to the outer circumferential surface 15P of the second rotating body 15 in an area of the outer circumferential surface 15P which passes the detection position D1 while the second rotating body 15 rotates by the rotation angle DR1. Two labels L are fixed to the outer circumferential surface 15P of the second rotating body 15 in an area of the outer circumferential surface 15P which passes the detection position D1 while the second rotating body 15 rotates by the rotation angle DR2. Four labels L are fixed to the outer circumferential surface 15P of the second rotating body 15 in an area of the outer circumferential surface 15P which passes the detection position DI while the second rotating body 15 rotates by the rotation angle DR3.

Figure 7A:
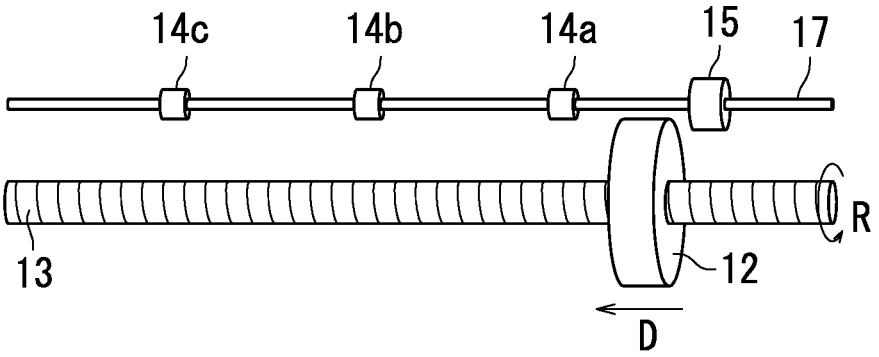
FIGS. 7A to 7D are perspective views of the conveying body, a first rotary shaft, a first rotating body group, the second rotary shaft, and the second rotating body.
Figure 7B:
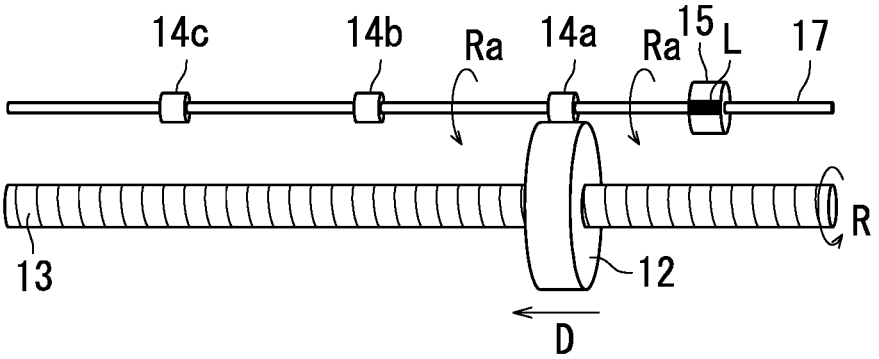
Figure 7C:
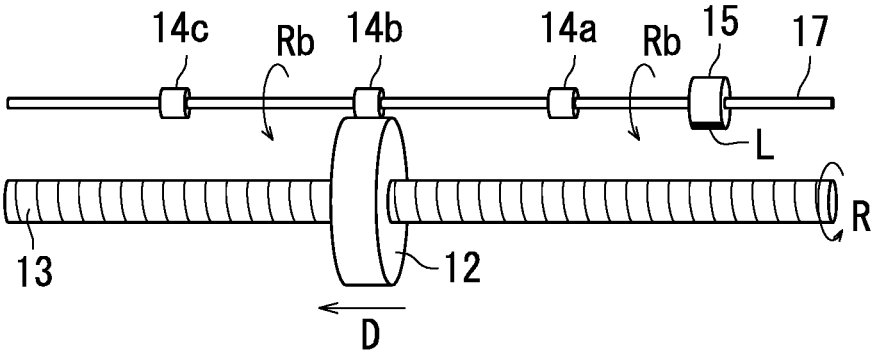
Figure 7D:
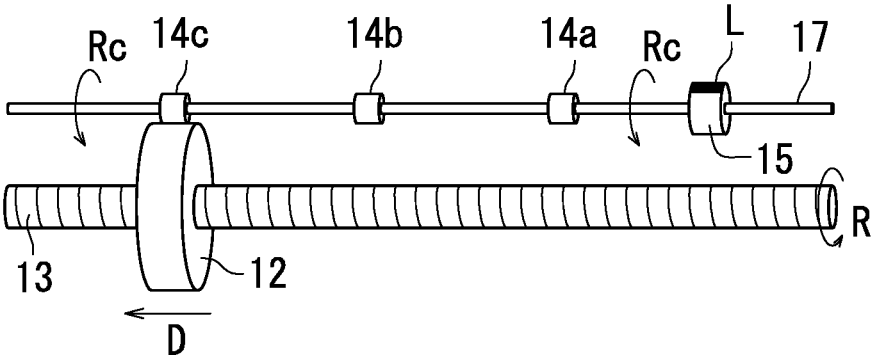

Next, a rotation mechanism of the second rotating body 15 is described with reference to FIGS. 7A to 7D. FIGS. 7A to 7D are perspective views of the conveying body 12, the first rotary shaft 13, the first rotating body group 14, the second rotary shaft 17, and the second rotating body 15. In detail, FIG. 7A illustrates a state in which the conveying body 12 moving in the exit port direction D while rotating is not engaged with the first rotating body group 14. FIG. 7B illustrates a state in which the conveying body 12 moving in the exit port direction D while rotating is engaged with the first rotating body 14*a*. FIG. 7C illustrates a state in which the conveying body 12 moving in the exit port direction D while rotating is engaged with the first rotating body 14*b*. FIG. 7D illustrates a state in which the conveying body 12 moving in the exit port direction D while rotating is engaged with the first rotating body 14*c*.

As illustrated in FIG. 7A, the conveying body 12 moves in the exit port direction D while rotating when the first rotary shaft 13 rotates in a rotation direction R. When the conveying body 12 moving in the exit port direction D while rotating is not engaged with the first rotating body group 14, the first rotating body group 14 does not rotate. Therefore, the second rotating body 15 does not rotate.

As illustrated in FIG. 7B, the first rotating body 14*a* rotates in a rotation direction Ra when the conveying body 12 moving in the exit port direction D while rotating engages with the first rotating body 14*a*. When the first rotating body 14*a* rotates in the rotation direction Ra, the second rotary shaft 17 rotates in the rotation direction Ra at the same rotational speed as the first rotating body 14*a*. That is, the second rotating body 15 rotates in the rotation direction Ra at the same rotational speed as the first rotating body 14*a*.

As illustrated in FIG. 7C, the first rotating body 14*b* rotates in a rotation direction Rb when the conveying body 12 moving in the exit port direction D while rotating engages with the first rotating body 14*b*. When the first rotating body 14*b* rotates in the rotation direction Rb, the second rotary shaft 17 rotates in the rotation direction Rb at the same rotational speed as the first rotating body 14*b*. That is, the second rotating body 15 rotates in the rotation direction Rb at the same rotational speed as the first rotating body 14*b*.

As illustrated in FIG. 7D, the first rotating body 14*c* rotates in a rotation direction Rc when the conveying body 12 moving in the exit port direction D while rotating engages with the first rotating body 14*c*. When the first rotating body 14*c* rotates in the rotation direction Rc, the second rotary shaft 17 rotates in the rotation direction Re at the same rotational speed as the first rotating body 14*c*. That is, the second rotating body 15 rotates in the rotation direction Rc at the same rotational speed as the first rotating body 14*c*.

Figure 8:
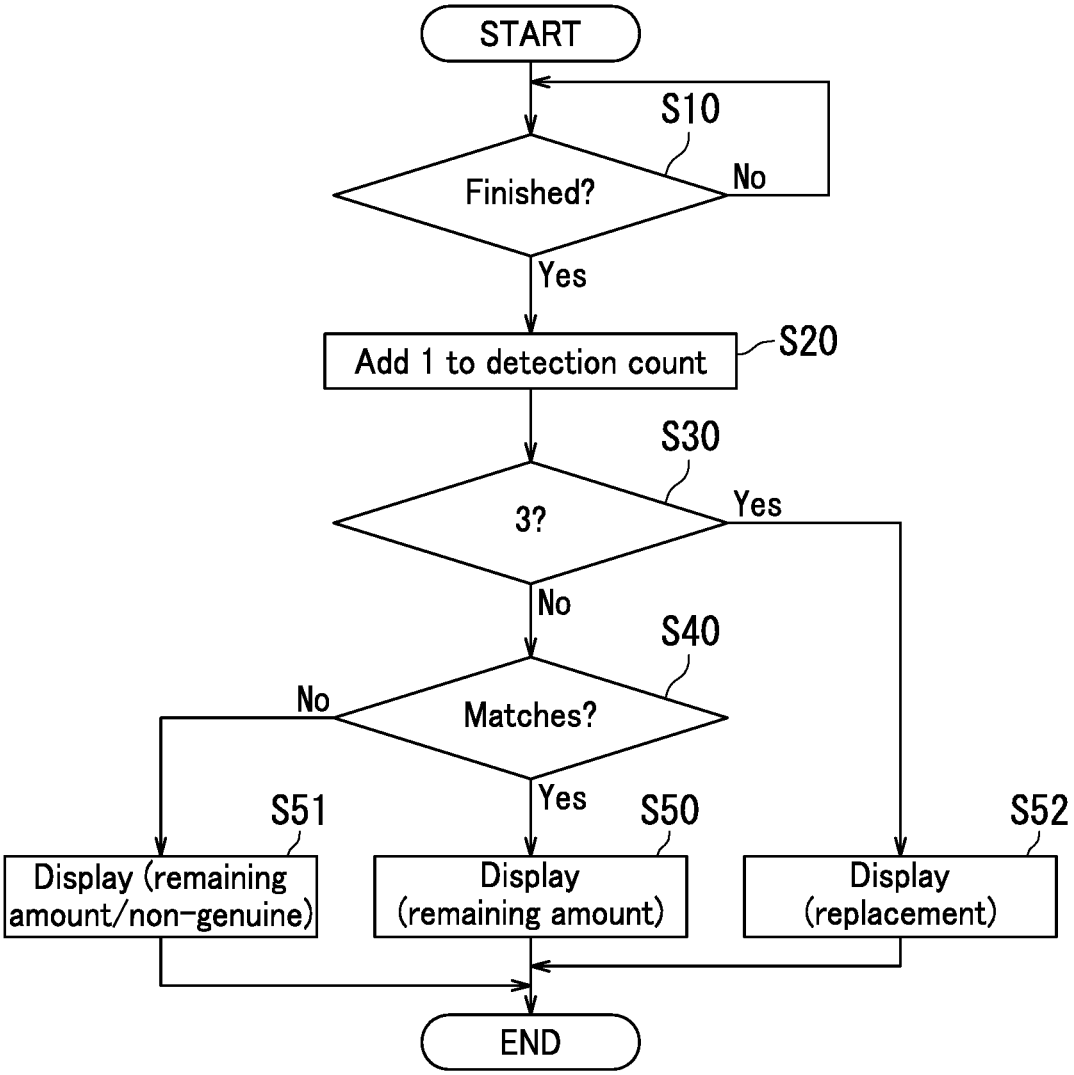
FIG. 8 is a flowchart depicting display processing performed by the image forming apparatus.

Next, the display processing is described with reference to FIG. 8. FIG. 8 is a flowchart illustrating the display processing performed by the image forming apparatus 100. The display processing starts in response to the processor 91 detecting rotation of the second rotating body 15 based on the result of detection by the optical sensor 20. The first storage 92 stores therein a detection count of the rotation of the second rotating body 15. In the following, one of the first rotating bodies 14*a* to 14*c* that is engaged with the conveying body 12 at the start of the display processing is referred to as a "specific first rotating body".

The detection count of the second rotating body 15 being 0 indicates that the conveying body 12 has not been engaged with any of the first rotating bodies 14*a* to 14*c*. The detection count being 1 indicates that the conveying body 12 has finished engagement with the first rotating body 14*a* but has not been engaged with the first rotating bodies 14*b* or 14*c*. The detection count being 2 indicates that the conveying body 12 has finished engagement with the first rotating bodies 14*a* and 14*b* but has not been engaged with the first rotating body 14*c*. The detection count being 3 indicates that the conveying body 12 has finished engagement with all of the first rotating bodies 14*a* to 14*c*. An example of adding to the detection count is described in the following. For example, in a case where the processor 91 causes the driving section 7 to generate driving force and detects the rotation of the second rotating body 15, the processor 91 adds 1 to the detection count stored in the first storage 92 when a prescribed period elapses from the processor 91 ceasing to detect the rotation of the second rotating body 15 while the driving section 7 is generating driving force.

Step S10: The processor 91 determines whether or not the prescribed period has elapsed from the second rotating body 15 ceasing to rotate based on the result of detection by the optical sensor 20 while the driving section 7 is generating driving force. When the processor 91 determines that the prescribed period has elapsed from the second rotating body 15 ceasing to rotate (Step S10: Yes), in other words that the conveying body 12 moving while rotating has finished engagement with the specific first rotating body, the processing advances to Step S20. In this case, the processor 91 stores the number of labels L detected by the optical sensor 20 between the start and the end of engagement of the specific first rotating body with the conveying body 12 as the detection count in the first storage 92. When the processor 91 determines that the prescribed period has not elapsed from the second rotating body 15 ceasing to rotate (Step S10: No), in other words that it is possible that the conveying body 12 moving while rotating is engaged with the specific first rotating body, the processing returns to Step S10.

Step S20: The processor 91 adds 1 to the detection count stored in the first storage 92. The processing advances to Step S30.

Step S30: The processor 91 determines whether or not the detection count is 3. When the processor 91 determines that the detection count is 3 (Step S30: Yes), in other words that the conveying body 12 has finished engagement with all of the first rotating bodies 14*a* to 14*c*, the processing advances to Step S52. When the processor 91 determines that the detection count is not 3 (Step S30: No), in other words that the conveying body 12 has not finished engagement with all of the first rotating bodies 14*a* to 14*c*, the processing advances to Step S40.

Step S40: The processor 91 acquires the number of labels L associated with the specific first rotating body from the container identification information stored in the first storage 92. in the following, the number of labels L from the container identification information is referred to as a "regulation count". The container identification information stored in the first storage 92 is an example of a "prescribed characteristic value". Also, the regulation count is an example of a "first characteristic value". The processor 91 acquires the detection count stored in the first storage 92. The detection count is an example of a "second characteristic value". The processor 91 determines whether or not the regulation count of labels L matches the detection count of labels L. When the processor 91 determines that the regulation count of labels L matches the detection count of labels L (Step S40: Yes), in other words that it is possible that the toner container 10 is a genuine product, the processing advances to Step S50. When the processor 91 determines that the regulation count of labels L does not match the detection count of labels L (Step S40: No), in other words that it is possible that the toner container 10 is not a genuine product, the processing advances to Step S51.

Step S50: The processor 91 causes the display section 61 to display a first message. The first message indicates the amount of remaining toner in the toner container 10. In detail, the amount of remaining toner in the toner container 10 in the first message indicates any one of a later-described "large", "medium", and "small". The processing ends.

In the first embodiment, the amount of remaining toner in the toner container 10 is set to four stages. In detail, the amount of remaining toner in the toner container 10 is classified into "large", "medium", "small", and "very small". "Large", "medium", "small", and "very small" indicate the size of the amount of remaining toner in the toner container 10 in the stated order. The processor 91 calculates the remaining amount of the toner T based on a result of detection by the optical sensor 20. In detail, in the first embodiment, the processor 91 classifies the amount of remaining toner in the toner container 10 as any of the four stages according to the detection count stored in the first storage 92. Specifically, when the detection count is 0, the processor 91 classifies the amount of remaining toner in the toner container 10 as "large". When the detection count is 1, the processor 91 classifies the amount of remaining toner in the toner container 10 as "medium". When the detection count is 2, the processor 91 classifies the amount of remaining toner in the toner container 10 as "small". When the detection count is 3, the processor 91 classifies the amount of remaining toner in the toner container 10 as "very small". In the first embodiment, the detection count being 3 indicates that the remaining amount of the toner T is less than a prescribed amount.

Step S51: The processor 91 causes the display section 61 to display a second message. The second message indicates the amount of remaining toner in the toner container 10 and that the toner container 10 is not a genuine product. In detail, the amount of remaining toner in the toner container 10 in the second message indicates any one of "large", "medium", and "small". The processing ends.

Step S52: The processor 91 causes the display section 61 to display a third message. The third message prompts replacement of the toner container 10. That is, the display section 61 notifies the user that the amount of remaining toner in the toner container 10 is "very small". The processing ends.

As described with reference to FIGS. 1 to 8, the toner container 10 includes a container main body 11, a conveying body 12, first rotating bodies 14*a* to 14*c*, and a second rotating body 15. The first rotating bodies 14*a* to 14*c* are located at prescribed positions. The first rotating bodies 14*a* to 14*c* rotate in response to the conveying body 12 arriving at the prescribed positions thereof. In the toner container 10, the second rotating body 15 rotates only when the conveying body 12 moving in an exit port direction D while rotating is engaged with any of the first rotating bodies 14*a* to 14*c*. For example, when the toner container 10 is attached to an image forming apparatus 100 which includes an optical sensor 20 that detects a rotational state of the second rotating body 15, the optical sensor 20 outputs to a processor 91 of the image forming apparatus 100 a signal indicating the rotational state of the second rotating body 15 only while the conveying body 12 is engaged with any of the first rotating bodies 14*a* to 14*c*. As a result, a burden on the processor 91 of the image forming apparatus 100 can be reduced.

The second rotating body 15 rotates each time the conveying body 12 engages with any of the first rotating bodies 14*a* to 14*c*. The first rotating bodies 14*a* to 14*c* cause the second rotating body 15 to rotate once when e conveying body 12 moves from a starting point to an ending point. When the toner container 10 is attached to the image forming apparatus 100, the toner container 10 allows the image forming apparatus 100 to accurately grasp the remaining amount of toner T contained in the container main body 11.

The second rotating body 15 has labels L on an outer circumferential surface 15P thereof. Therefore, the toner container 10 can be made smaller in size than in a case where the second rotating body 15 includes a detecting plate.

The image forming apparatus 100 includes a toner container 10, a driving section 7, an optical sensor 20, and a processor 91. The processor 91 calculates the remaining amount of the toner T based on a result of detection by the optical sensor 20. In a case where a display section 61 is included which displays information, the image forming apparatus 100 can inform a user of the remaining amount of the toner T.

The image forming apparatus 100 further includes a display section 61. The processor 91 determines whether or not a detection count is 3. In other words, the processor 91 determines whether or not the remaining amount of the toner T is less than a prescribed amount. When the detection count is 3, in other words, the remaining amount of the toner T is determined to be less than the prescribed amount, the processor 91 causes the display section 61 to display a message for replacement of the toner container 10. The image forming apparatus 100 can notify the user that the remaining amount of the toner T is small before the remaining amount of the toner T is depleted.

The optical sensor 20 includes a light receiving and emitting section. The light receiving and emitting section includes a light emitting element and a photo detector. The image forming apparatus 100 can be made smaller than in a configuration which uses a disk-shaped detection plate with a slit therein and a detecting member which detects the presence or absence of the slit in the detection plate as a detecting section to detect the rotation count of the second rotating body 15.

The toner container 10 includes first rotating bodies 14*a* to 14*c* and second storage 16. The second storage 16 stores container identification information therein. The processor 91 acquires a detection count of labels L from a result of detection by the optical sensor 20. The processor 91 reads out a corresponding regulation count of labels L from numbers of labels L respectively associated with the first rotating bodies 14*a* to 14*c* in the container identification information stored in the second storage 16. The processor 91 compares the regulation count of labels L to the detection count of labels L. When the regulation count of labels L does not match the detection count of labels L, the processor 91 determines that the toner container 10 is not a genuine product. The image forming apparatus 100 can easily determine whether or not the attached toner container 10 is a genuine product.

Second Embodiment

Figure 9:
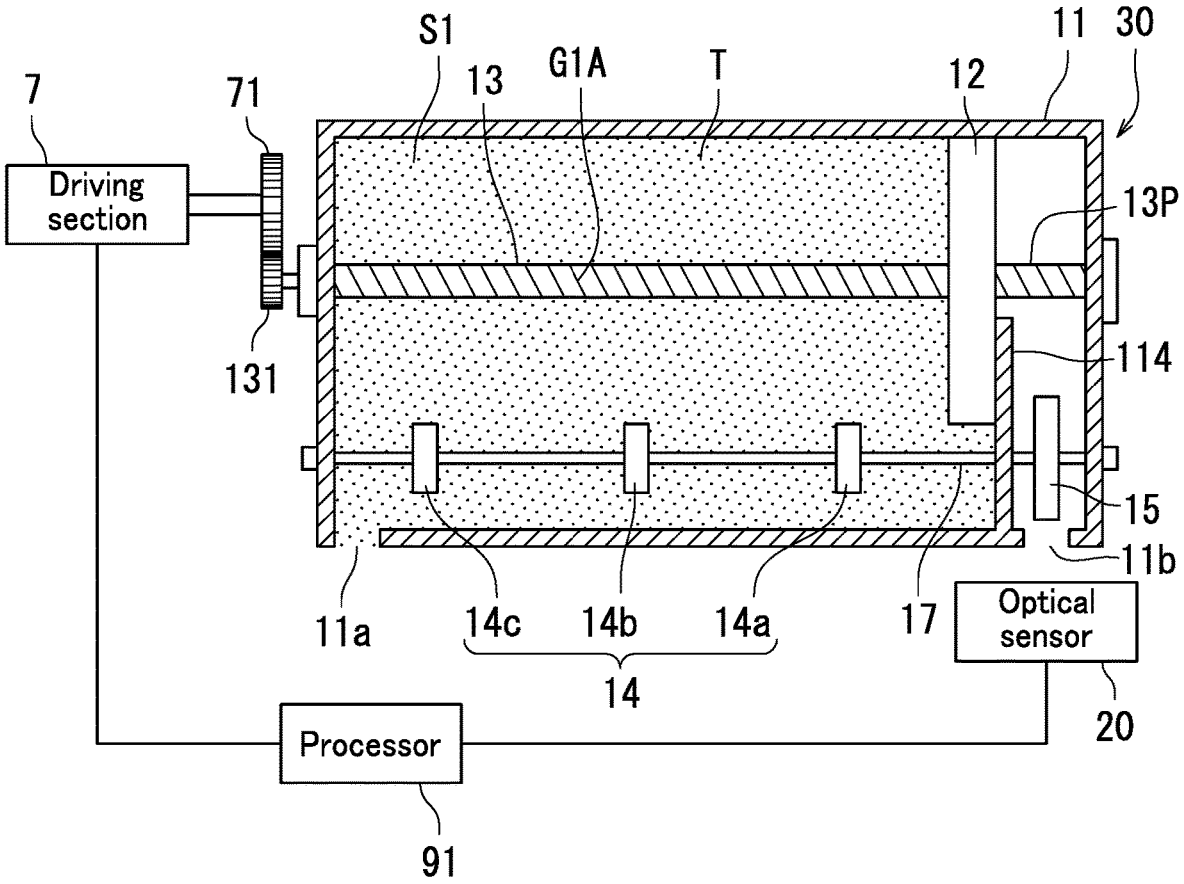
FIG. 9 is a diagram illustrating a cross section of the toner container according to a second embodiment of the present disclosure.

The following describes a toner container 30 according to a second embodiment with reference to FIG. 9. FIG. 9 is a diagram illustrating a cross section of the toner container 30 according to the second embodiment.

The toner container 30 includes a container main body 11 with a different configuration than that of the toner container 10 of the first embodiment.

As illustrated in FIG. 9, the toner container 30 includes a container main body 11, a conveying body 12, a first rotary shaft 13, a first rotating body group 14, a second rotary shaft 17, and a second rotating body 15. The toner container 30 further includes second storage 16.

The container main body 11 of the second embodiment differs from the container main body 11 of the first embodiment by not having a second container compartment S2. The first container compartment S1 of the second embodiment contains toner T. the conveying body 12, the first rotary shaft 13, the first rotating body group 14, the second rotary shaft 17, and the second rotating body 15. The container main body 11 of the second embodiment has a third inner wall 114 in the first container compartment S1 instead of the first inner wall 112 of the first embodiment. The third inner wall 114 prevents the toner T from moving to the second rotating body 15.

Embodiments of the present disclosure are described above with reference to the accompanying drawings (FIGS. 1 to 9). However, the present disclosure is not limited to the above embodiments and may be implemented in various manners within a scope not departing from the gist thereof (as described below in (1) to (3), for example). The drawings illustrate main elements of configuration schematically to facilitate understanding. Aspects such as thickness, length, and number of the elements of configuration illustrated in the drawings may differ in practice for convenience of drawing preparation. Aspects such as material, shape, and dimension of the elements of configuration illustrated in the above embodiments are but one example and not particular limitations. The elements of configuration may be variously altered within a scope not substantially departing from the effects of the present disclosure.

(1) In the first and second embodiments of the present disclosure as described with reference to FIGS. 1 to 9, the number of first rotating bodies 14*a* to 14*c* is three, but the present disclosure is not limited as such. For example, the number of first rotating bodies may be one, two, or four or more.

(2) In the first and second embodiments of the present disclosure as described with reference to FIGS. 1 to 9. the second rotating body 15 has labels L fixed to the outer circumferential surface 15P thereof as detection targets, but the present disclosure is not limited as such. For example, a detection target may be a protrusion, a recess, or a slit.

(3) In the first and second embodiments of the present disclosure as described with reference to FIGS. 1 to 9, the optical sensor 20 is used as a detector, but the present disclosure is not limited as such. For example, the detector may be an electronic camera. Also in the first and second embodiments of the present disclosure, the image forming apparatus 100 includes the optical sensor 20, but the present disclosure is not limited as such. For example, the toner container 10 may include the optical sensor 20.

What is claimed is:

1. A toner container comprising:

a container main body which has a compartment that contains toner and an exit port which allows the toner to be ejected from the compartment;

a conveying body located inside the compartment and configured to move in a direction approaching the exit port while rotating to convey the toner to the exit port;

at least one first rotating body configured to engage with an outer circumferential surface of the conveying body and rotate according to rotation of the conveying body; and a second rotating body configured to rotate according to a first driving force generated by rotation of the first rotating body, wherein the first rotating body is located at a prescribed position, and the first rotating body rotates in response to the conveying body arriving at the prescribed position.

2. The toner container according to claim 1, wherein the first rotating body is provided as a plurality of first rotating bodies, the second rotating body rotates each time the conveying body engages with any of the first rotating bodies, and the first rotating bodies cause the second rotating body to rotate once when the conveying body moves from a starting point to an ending point, the starting point set to a position away from the exit port in the compartment and the ending point set to a position near the exit port.

3. The toner container according to claim 1, wherein the second rotating body has detection targets on an outer circumferential surface thereof which indicate that the second rotating body has rotated.

4. An image forming apparatus which forms an image on a sheet, the image forming apparatus comprising:

the toner container according to claim 3;

a driving section configured to generate a second driving force which drives the conveying body;

a detector configured to detect any of the detection targets from the second rotating body when the second rotating body rotates; and a processor configured to calculate a remaining amount of the toner based on a result of detection by the detector.

5. The image forming apparatus according to claim 4, further comprising a display section configured to display information, wherein the processor determines whether or not the remaining amount of the toner is less than a prescribed amount, and causes the display section to display a message for replacement of the toner container when determining that the remaining amount of the toner is less than the prescribed amount.

6. The image forming apparatus according to claim 4, wherein the detector includes a light receiving and emitting section, and the light receiving and emitting section includes a light emitting element which emits light and a photo detector which receives light.

7. The image forming apparatus according to claim 4, wherein the toner container includes storage, the first rotating body is provided as a plurality of first rotating bodies, the second rotating body rotates each time the conveying body engages with any of the first rotating bodies, the storage stores therein prescribed characteristic values respectively associated with the first rotating bodies, the detector detects any of the detection targets each time the second rotating body rotates, the processor reads out, based on a result of detection by the detector, one of the prescribed characteristic values stored in the storage as a first characteristic value, and the processor acquires a characteristic value from the result of detection by the detector and compares a second characteristic value which is the acquired characteristic value to the first characteristic value, and when the first characteristic Value does not match the second characteristic value, the processor determines that the toner container is not a genuine product.

8. The image forming apparatus according to claim 7, wherein each of the characteristic values indicates a number of the detection targets.

* * * * *